US008393498B2

(12) United States Patent
Ma

(10) Patent No.: US 8,393,498 B2
(45) Date of Patent: Mar. 12, 2013

(54) TOY GUNS

(75) Inventor: Chor-Ming Ma, Kowloon (CN)

(73) Assignee: Buzz Bee Toys (H.K.) Co., Limited, Kowloon, Hong Kong (CN)

( * ) Notice: Subject to any disclaimer, the term of this patent is extended or adjusted under 35 U.S.C. 154(b) by 295 days.

(21) Appl. No.: 12/839,661

(22) Filed: Jul. 20, 2010

(65) Prior Publication Data

US 2011/0315710 A1 Dec. 29, 2011

(30) Foreign Application Priority Data

Jun. 23, 2010 (HK) ..... 10106226.1

(51) Int. Cl.
*A63H 3/18* (2006.01)

(52) U.S. Cl. ..... 222/79; 446/267

(58) Field of Classification Search ..... 222/79, 222/373, 324, 323, 402, 339, 391; 446/473, 446/153, 267; 124/65–67
See application file for complete search history.

(56) References Cited

U.S. PATENT DOCUMENTS

| | | | | |
|---|---|---|---|---|
| 5,184,756 | A * | 2/1993 | Amron | 222/79 |
| 5,531,210 | A * | 7/1996 | Meiser et al. | 124/66 |
| 7,032,837 | B2 * | 4/2006 | Eddins et al. | 239/255 |
| 7,861,891 | B2 * | 1/2011 | Amron | 222/79 |
| 2005/0096506 | A1 * | 5/2005 | Nishtala et al. | 600/201 |
| 2006/0241655 | A1 * | 10/2006 | Viola | 606/142 |

FOREIGN PATENT DOCUMENTS

| | | |
|---|---|---|
| CN | 2147505 | 8/1993 |
| CN | 2663910 | 11/2003 |
| CN | 2795788 | 4/2005 |
| CN | 201059908 | 4/2007 |
| JP | 2006-300464 | 11/2006 |

* cited by examiner

*Primary Examiner* — Lien Ngo
(74) *Attorney, Agent, or Firm* — Alix, Yale & Ristas, LLP

(57) ABSTRACT

A toy gun has a body, a chamber and a nozzle. A piston moves within the chamber to cause fluid in the chamber to be emitted via the nozzle. A handle is connected to the body, and a gear mechanism cooperates with the handle and the piston to convert movement of the handle to lesser or greater movement of the piston.

10 Claims, 6 Drawing Sheets

TOY GUNS

BACKGROUND OF THE INVENTION

The present invention relates to toy guns such as water-shooting toy guns (otherwise known as water pistols, water blasters, water cannons or soakers) and toy guns that use a blast of air to fire a projectile such as a soft dart. The invention more particularly, although not exclusively, relates to such toy guns having a light priming or pumping action suitable for small children.

Toy guns sometimes require priming by the user to pre-load a strong spring which upon release forces a piston into a firing bay to cause water or air to escape rapidly via a nozzle or aperture. A good blast of water or air requires that the firing spring be quite strong. Priming is usually performed by pulling back on a priming handle which is attached to the spring-loaded piston. The user must pull back hard on the priming handle against the full force of the firing spring. Small children may not have sufficient physical strength to prime such toy guns.

Other toy guns of the type mentioned do not require priming, but are configured to fire immediately upon activation of a pumping handle or trigger. Such toy guns have a direct relationship of movement between the pump handle and the piston and as such the speed of activation of the pump handle directly determines the distance of trajectory. Small children may not have sufficient strength to achieve a good trajectory with such toy guns.

SUMMARY OF THE DISCLOSURE

There is disclosed herein a toy gun, comprising:

a body;

a chamber;

a nozzle;

a piston movable within the chamber to cause fluid in the chamber to be emitted via the nozzle;

a movable handle connected to the body; and a gear mechanism cooperating with the handle and the piston to convert movement of the handle to lesser or greater movement of the piston.

Preferably, the gear mechanism comprises a first rack attached to or formed integrally with the handle to move therewith, a second rack fixed to or formed integrally with the body, and one or more gears attached to the piston and cooperating with both racks.

The toy gun can further comprise a reservoir from which stored water is delivered to the chamber via a conduit and a one-way valve.

The toy gun can further comprise a nozzle cover adapted to open the nozzle upon movement of the handle.

The toy gun can further comprise a carriage attached to the body and movable by the handle and wherein the nozzle cover is attached pivotally to the body and a linkage extends from the nozzle cover to the carriage.

Alternatively, the handle is a priming handle and a spring bears against the piston, and wherein movement of the priming handle loads the spring.

Alternatively, the handle is a firing handle causing movement of the piston in either direction and wherein the chamber has a second one-way valve via which water passes to the nozzle.

Preferably, said one or more gears comprise one gear only, and wherein the teeth of the gear mesh with the teeth of both racks.

Preferably, said one or more gears comprises two gears of different size fixed on a common shaft, and wherein the teeth of one gear mesh with the teeth of one of the racks and the teeth of the other gear mesh with the teeth of the other rack.

One preferred embodiment further comprises a firing bay for receiving a soft projectile and the nozzle interacts with the projectile to cause the projectile to be fired from the firing bay upon said emission of fluid via the nozzle.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
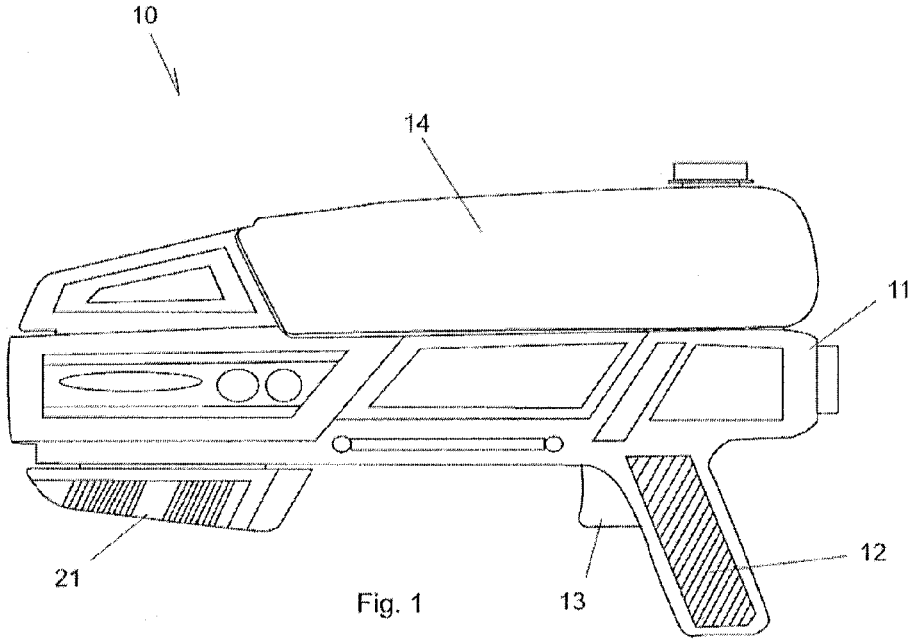
FIG. 1 is a schematic elevation of a water-shooting toy gun.
Figure 2:
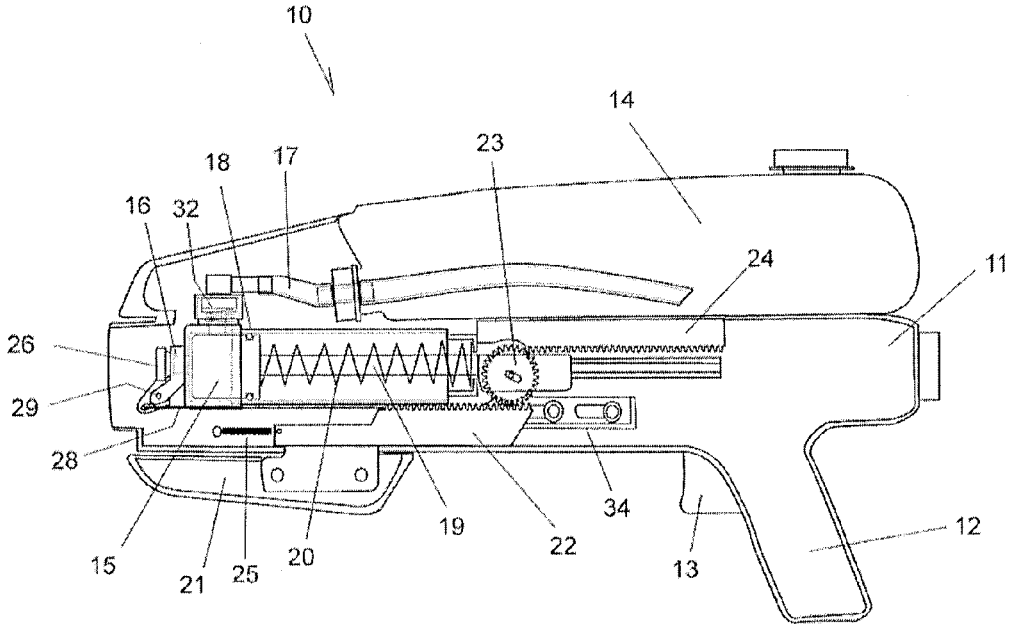
FIG. 2 is a schematic cross-sectional elevation of the water-shooting toy gun of FIG. 1.
Figure 3:
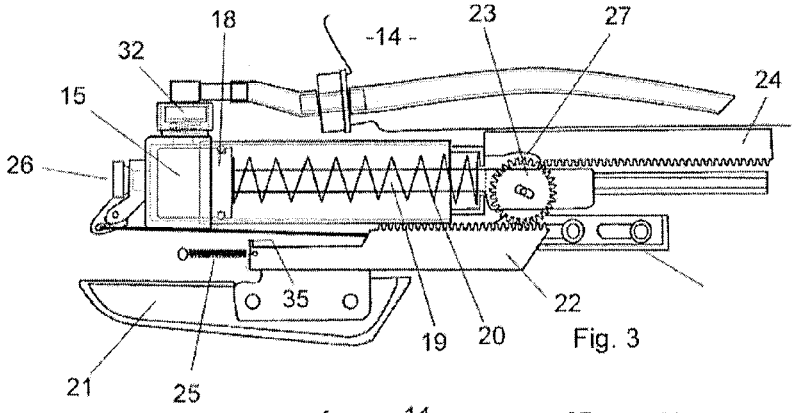
FIGS. 3 to 10 are schematic cross-sectional elevations of the water-shooting toy gun of the preceding figures during various stages of firing, with FIG. 8A being a detailed illustration of the gear and first rack.
Figure 4:
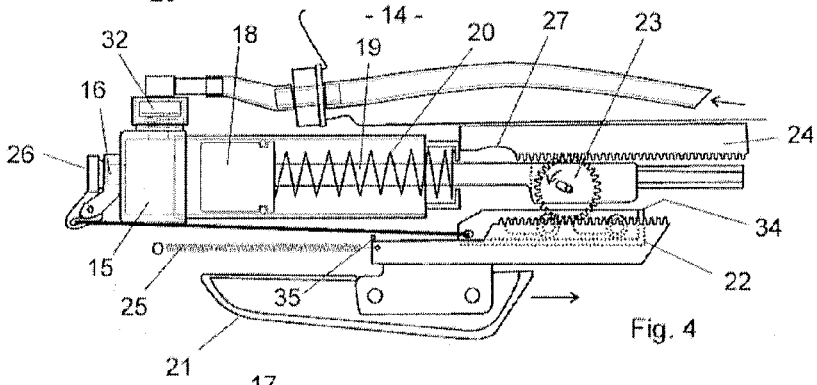
Figure 5:
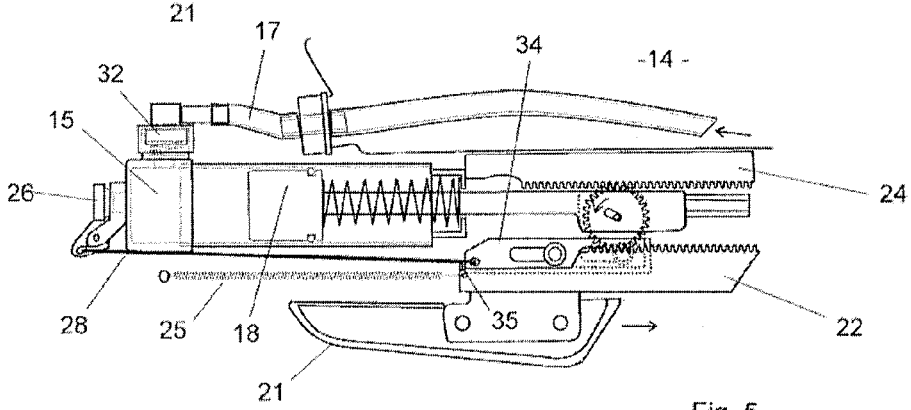

In FIGS. 1 to 10 of the accompanying drawings there is depicted schematically a first embodiment of a water-shooting toy gun 10. It includes a body 11 typically formed of moulded plastics. The body has an integral handle 12 with a false trigger 13. The body 11 supports a reservoir 14 from which a conduit 17 extends to deliver water therein to a chamber 15 via a one-way valve 32.

At the front of the body 11 there is a nozzle 16 via which water from the chamber 15 is to be emitted.

A piston 18 extends into the chamber 15. The piston is attached to or formed integrally with a piston rod 19 which is surrounded by a coil spring 20. The coil spring 20 urges the piston 18 toward the nozzle 16.

Connected to the tail portion of the piston rod 19 is a rotating gear 23. The gear 23 moves back and forth together with the piston rod 19 and engages with a pair of racks 22 and 24.

The first rack 22 is fixed to or formed integrally with a priming handle 21. The priming handle 21 is mounted movably to the body 11 and has a light return spring 25 to urge it toward the left.

The second rack 24 is fixed to or formed integrally with the body 11 and does not move. The rack 24 includes a recess 27 at its forward end within which the gear 23 could spin without engaging the teeth of the rack.

In front of the nozzle 16 is a nozzle cover 26 that pivots at 29 and normally seals against the nozzle.

A linkage 28 extends from the nozzle cover 26 to a carriage 34. The carriage 34 is mounted to the body by pins which fit into elongate slots so that the carriage can slide back and forth throughout a finite range. At the forward end of the first rack 22 there is a stop 35 which bears against the carriage 34 at a certain position of its travel to cause the carriage to move to the right thereby pulling the linkage 28 to open the nozzle cover 26. A spring or other means (not shown) would bias the cover and/or carriage to the closed position.

In use, the handle 21 is drawn back so that the first rack 22 causes the gear 23 to turn and move to the right thereby engaging with the second rack 24. The piston rod 19 and piston 18 move to the right at a speed and displacement that is half that of the handle 21. This 2:1 mechanical advantage means that the force applied by the user upon handle 21 is only approximately half that which would otherwise be required to compress the coil spring 20 directly. Expansion of the chamber 15 draws water via one-way valve 32 into the chamber.

Figure 6:
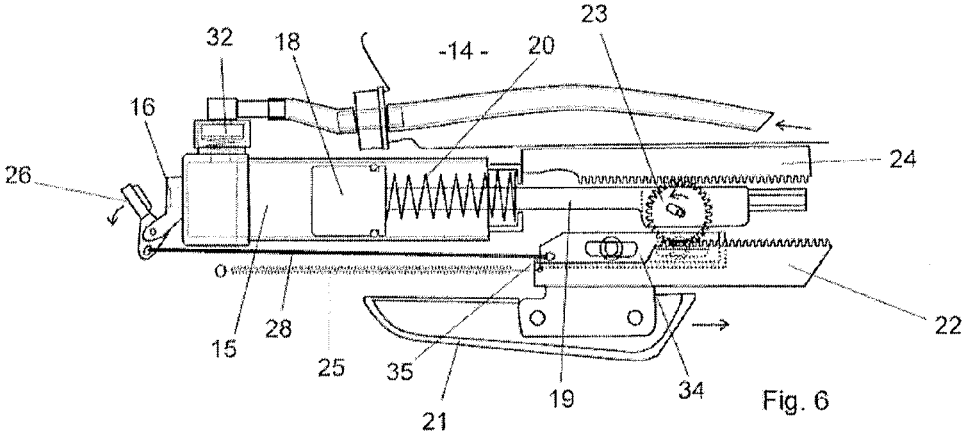
Figure 7:
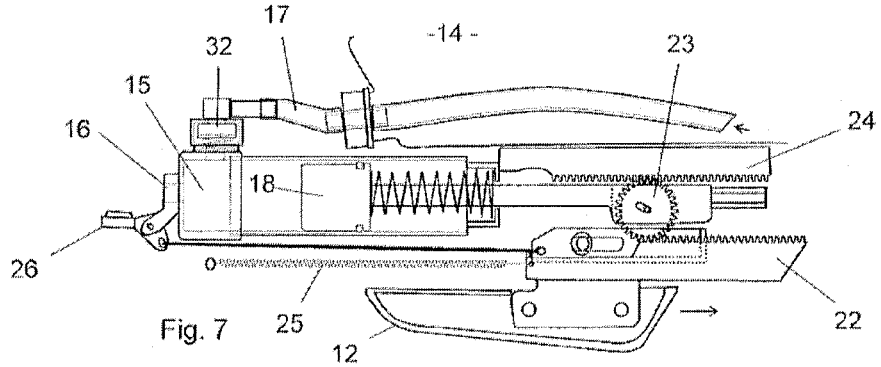
Figure 8:
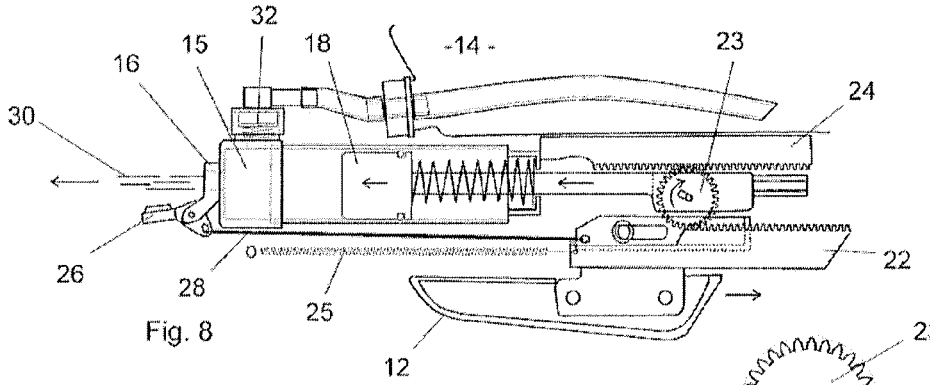
Figure 8A:
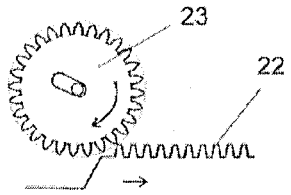
Figure 9:
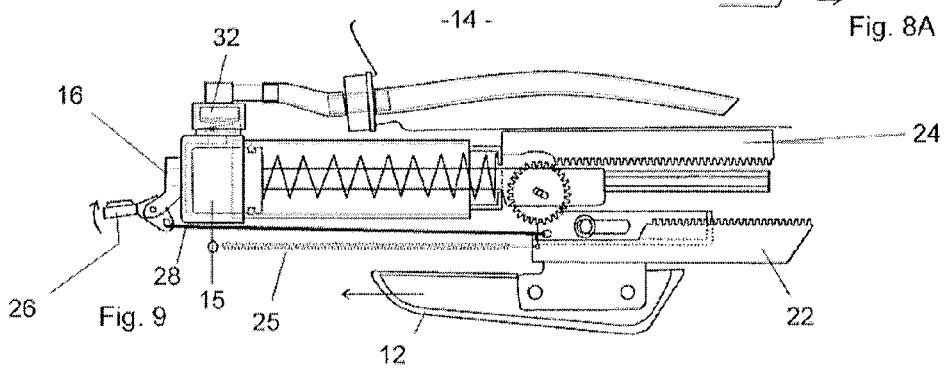
Figure 10:
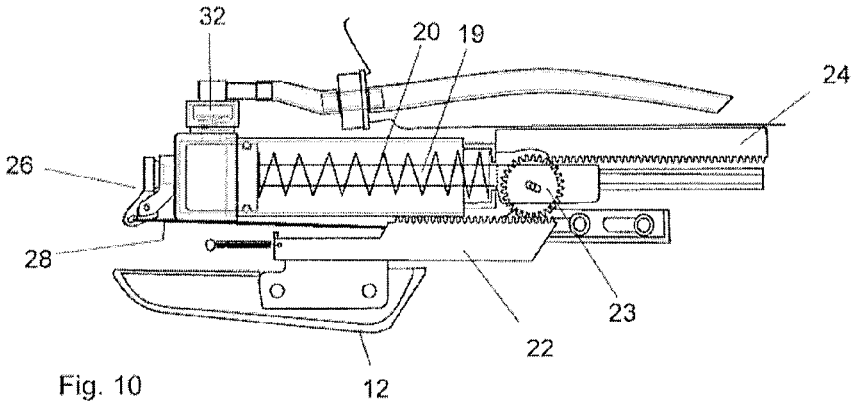

When the handle reaches the position depicted in FIG. 6, the stop 35 engages the carriage 34 to open the nozzle cover 26 as described. When the handle reaches the position depicted in FIG. 8, the gear 23 disengages the teeth of the first rack 22 and the spring 20 forces the piston rapidly to the left to cause a water jet 30 to be emitted via the nozzle 16. The gear 23 will be spinning rapidly but as it enters the recess 27 of the second rack it can spin to rest as the cover 26 closes the nozzle 16. This prevents a jolt in the gear mechanism which might otherwise cause undue wear on the teeth.

Figure 11:
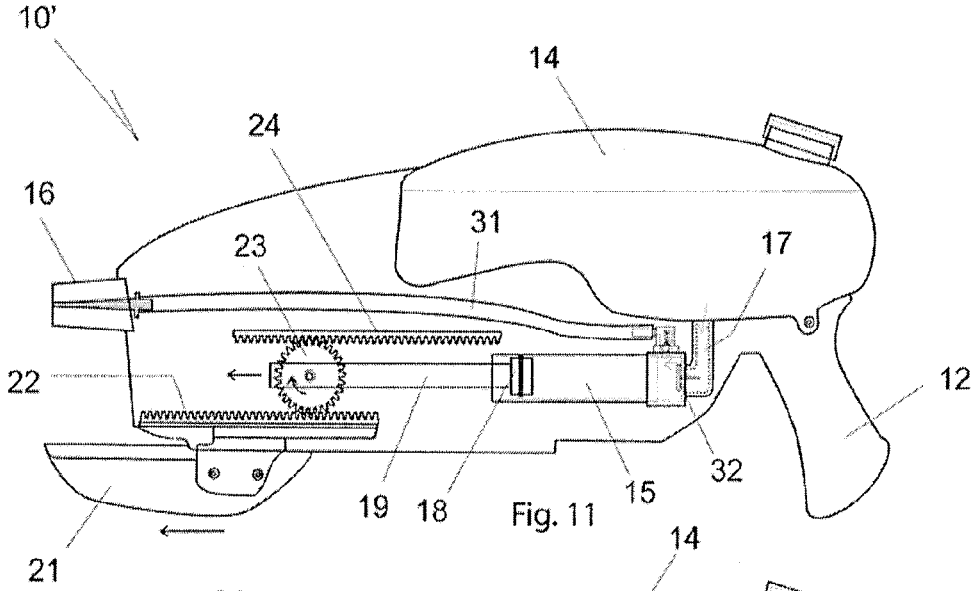
FIGS. 11 to 13 are schematic cross-sectional elevations of another water-shooting toy gun during various stages of firing.
Figure 12:
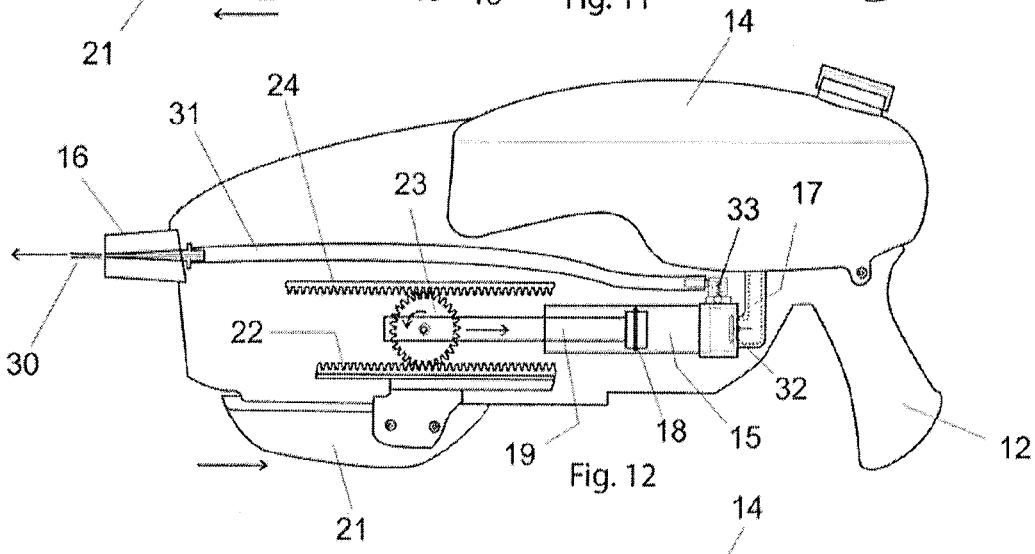
Figure 13:
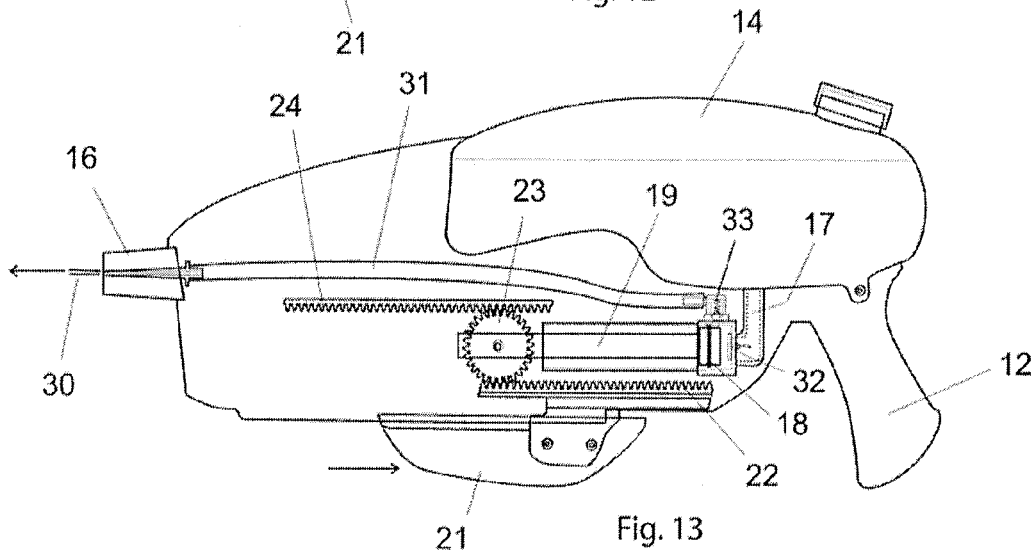

Another embodiment is depicted in FIGS. 11 to 13. This toy gun 10' does not require priming. Instead, when the handle 21 is moved to the right, water is emitted immediately. Rather than providing a nozzle cover, a second one-way valve 33 is provided across a nozzle conduit 31 to the nozzle 16. When the handle is moved back to the left the one-way valve 33 seals so that water can be drawn from the reservoir 14 via the one-way valve 32 to replenish the chamber 15. The mechanical advantage afforded by this embodiment is again 2:1.

Figure 14:
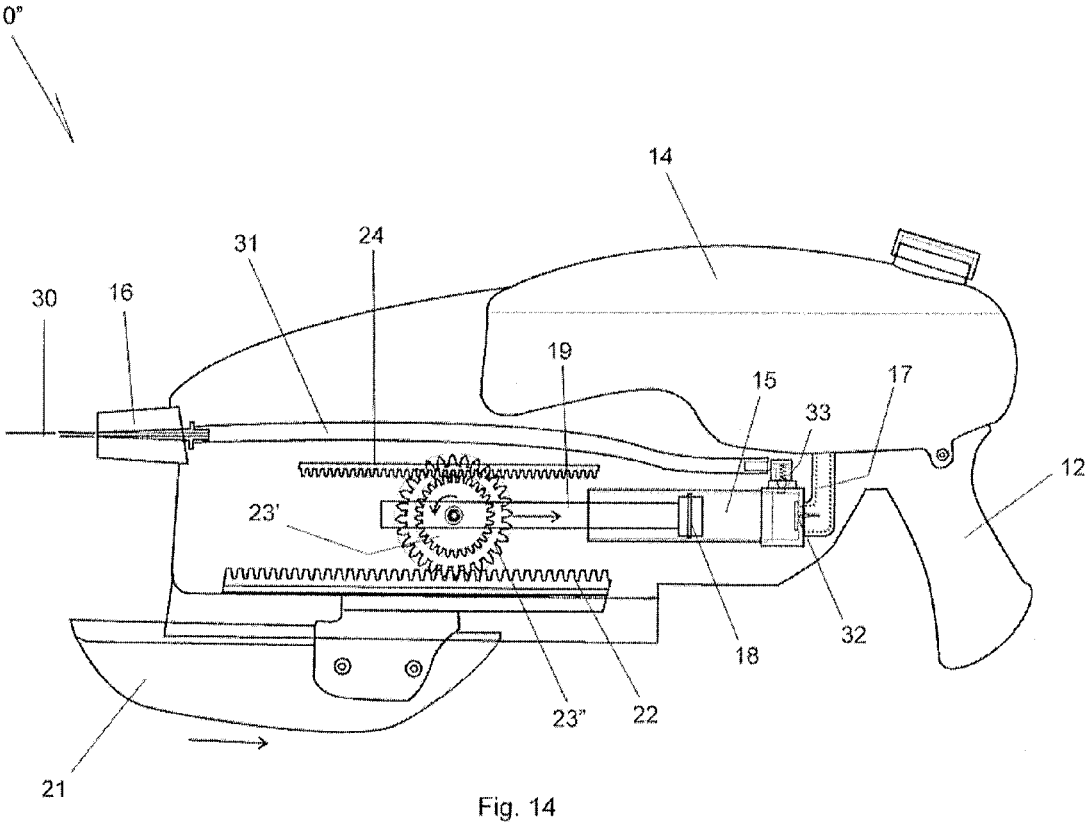
FIG. 14 is a schematic cross-sectional elevation of yet another water-shooting toy gun.
Figure 15:
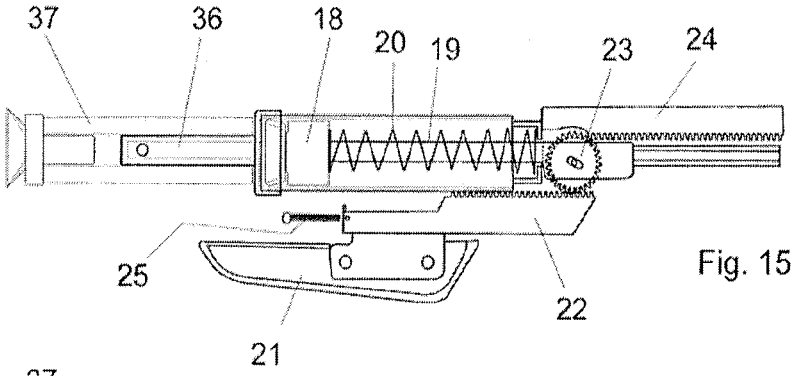
FIGS. 15 to 18 are schematic cross-sectional elevations of a toy gun mechanism for firing a soft projectile with a blast of air during various stages of firing.

A further refinement is shown in FIG. 14. In this toy gun 10" there are two different sized gears 23' and 23" fixed upon or formed integrally with a common shaft. One gear engages with the fixed rack 24 and the other engages with the moving rack 22. By appropriate selection of gear sizes, mechanical advantages other than 2:1 can be achieved. That is, as well as further easing the level of force for small children, a step-up configuration could be provided so the piston movement is actually faster than that of the handle. This might suit older/stronger children to achieve maximum water trajectory.

Figure 16:
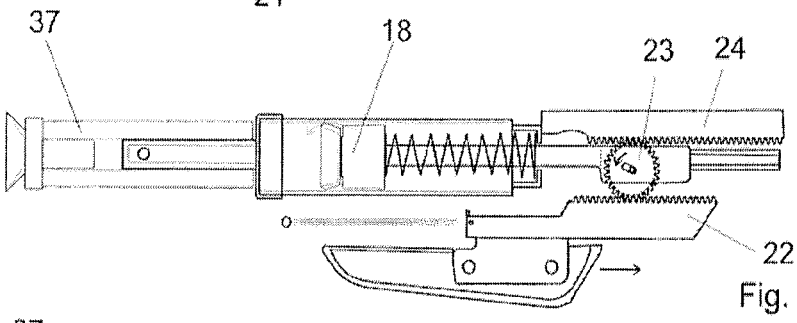
Figure 17:
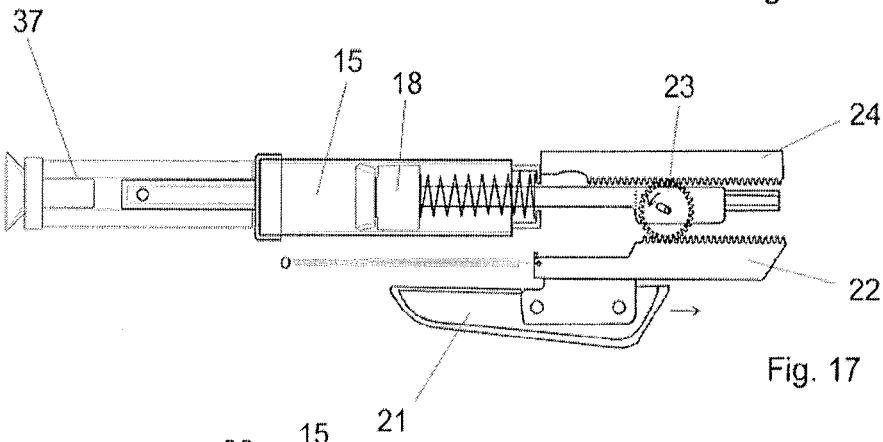
Figure 18:
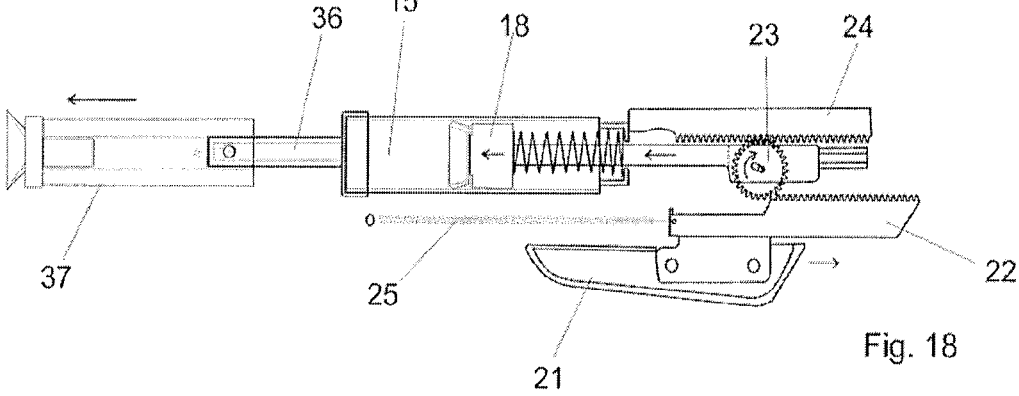

FIGS. 15 to 18 show a mechanism similar to that of FIGS. 3 to 10 for use in a toy gun designed for shooting a soft projectile with a blast of air. In this embodiment, the chamber 15 receives air rather than water. The nozzle is in the form of an elongate hollow tube 36 and this extends into a firing bay at which a soft tubular projectile 37 is loaded upon the tube. Air from the chamber 15 passes into a hollow of the soft projectile 37 via an aperture at or near the tip of the tube to cause the projectile to fire. As the handle 21 is moved to the right, the piston 18 is drawn back against the spring 20. As the piston 18 fits loosely inside the cylinder, air can leak around it as shown in FIG. 16 to fill the chamber 15. The racks 22 and 24 interact with the gear 23 as described previously so that firing takes place when the gear disengages the teeth at the left end of the rack 22 as shown in FIG. 18. A return spring 25 biases the handle back to the start position.

It should be appreciated that modifications and alterations obvious to those skilled in the art are not to be considered as beyond the scope of the present invention. For example, the nozzle cover 26 could be activated by means other than the carriage and linkage depicted. Also, any of the mechanisms described with reference to water blasters could be used in toy guns designed for shooting a soft projectile with a blast of air and mechanical movement ratios other than 2:1 can of course be provided for the air-blasting versions.

The invention claimed is:

1. A toy gun, comprising:
- a body;
- a chamber;
- a nozzle;
- a piston movable within the chamber to cause fluid in the chamber to be emitted via the nozzle;
- a movable handle connected to the body;
- a gear mechanism cooperating with the handle and the piston to convert movement of the handle to lesser or greater movement of the piston; and
- a nozzle cover adapted to open the nozzle upon movement of the handle.

2. The toy gun of claim 1, wherein the gear mechanism comprises a first rack attached to or formed integrally with the handle to move therewith, a second rack fixed to or formed integrally with the body, and one or more gears attached to the piston and cooperating with both racks.

3. The toy gun of claim 1, further comprising a reservoir from which stored water is delivered to the chamber via a conduit and a one-way valve.

4. The toy gun of claim 1, further comprising a carriage attached to the body and movable by the handle and wherein the nozzle cover is attached pivotally to the body and a linkage extends from the nozzle cover to the carriage.

5. The toy gun of claim 1, wherein the handle is a priming handle and a spring bears against the piston, and wherein movement of the priming handle loads the spring.

6. The toy gun of claim 3, wherein the handle is a firing handle causing movement of the piston in either direction, and wherein the chamber has a second one-way valve via which water passes to the nozzle.

7. The toy gun of claim 2, wherein said one or more gears comprises one gear only, and wherein the teeth of the gear mesh with the teeth of both racks.

8. The toy gun of claim 2, wherein said one or more gears comprises two gears of different size fixed on a common shaft, and wherein the teeth of one gear mesh with the teeth of one of the racks and the teeth of the other gear mesh with the teeth of the other rack.

9. The toy gun of claim 1, further comprising a firing bay for receiving a soft projectile and wherein the nozzle interacts with the projectile to cause the projectile to be fired from the firing bay upon said emission of fluid via the nozzle.

10. A toy gun, comprising:
- a body;
- a chamber;
- a nozzle;
- a piston movable within the chamber to cause fluid in the chamber to be emitted via the nozzle;
- a movable handle connected to the body; and
- a gear mechanism cooperating with the handle and the piston to convert movement of the handle to lesser or greater movement of the piston;
- wherein the gear mechanism comprises a first rack attached to or formed integrally with the handle to move therewith, a second rack fixed to or formed integrally with the body, and one or more gears attached to the piston and cooperating with both racks.

* * * * *